US005816748A

United States Patent [19]

Kleiser et al.

[11] Patent Number: 5,816,748

[45] Date of Patent: Oct. 6, 1998

[54] METHOD FOR SEALING OFF GROUND SITES

[75] Inventors: Klaus Kleiser, Stutensee-Büchig; Hans-Joachim Bayer, Ettlingen; Jörg Gänger, Straubenhardt; Klaus-Dieter Bilkenroth, Hohemölsen; Ortwin Caldonazzi, Leipzig; Herbert Baier, Bitterfeld; Manfred Heilmann, Freiberg; Hans-Jürgen Kretzschmar, Freiberg, all of Germany

[73] Assignee: Flowtex Technologie-Import Von Kabelverlegemaschinen GmbH, Ettlinger, Germany

[21] Appl. No.: 599,547

[22] Filed: Oct. 24, 1995

[30] Foreign Application Priority Data

Apr. 28, 1993 [DE] Germany ..... 43 13 944.9
Oct. 15, 1993 [DE] Germany ..... 43 35 290.1

[51] Int. Cl.[6] ..... E21B 7/06

[52] U.S. Cl. ..... 405/268; 405/266; 405/269; 175/61; 588/250

[58] Field of Search ..... 405/129, 266, 405/267, 268, 269, 270; 175/61; 588/250, 252, 253

[56] References Cited

U.S. PATENT DOCUMENTS

| | | | |
|---|---|---|---|
| 3,608,318 | 9/1971 | Levy et al. | 405/266 |
| 4,311,340 | 1/1982 | Lyons et al. | 405/267 X |
| 4,615,643 | 10/1986 | Gouvenot | 588/250 X |
| 4,637,462 | 1/1987 | Grable | 166/245 |
| 4,787,464 | 11/1988 | Dickinson, III et al. | 175/67 |
| 4,900,196 | 2/1990 | Bridges | 405/267 |
| 4,930,586 | 6/1990 | Turin et al. | 175/25 |

FOREIGN PATENT DOCUMENTS

| | | | |
|---|---|---|---|
| 0317369 | 5/1989 | European Pat. Off. | B09B 1/00 |
| 3410132 | 10/1985 | Germany | E02D 31/00 |
| 3415883 | 10/1985 | Germany | E02D 31/00 |
| 3330897C2 | 9/1986 | Germany . | |
| 3722270A1 | 2/1988 | Germany . | |
| 4033884C1 | 10/1991 | Germany . | |
| 3439858C2 | 12/1991 | Germany . | |
| 3407382C2 | 8/1994 | Germany . | |
| 9300483 | 1/1993 | WIPO . | |

OTHER PUBLICATIONS

Huck, et al., Innovative Geotechnical Approaches to the Remedial In–Situ Treatment of Hazardous Materials Disposal Sites, Proc. 1980 Nat. Conf. on "Control of Hazardous Materials Spills," May 13–15, 1980, Louisville, KY, USA.

*Primary Examiner*—Tamara L. Graysay
*Assistant Examiner*—Tara L. Mayo
*Attorney, Agent, or Firm*—Hughes Hubbard & Reed LLP; Ronald Abramson

[57] ABSTRACT

The invention pertains to a process for sealing off ground sites in particular a waste dump, abandoned dumping grounds, pipelines or the like, or also excavated construction sites, using sealants, wherein a fully course-controlled boring technique is used to drive at least one bore underneath the ground site from the surface outside the ground site and the sealant is injected into the soil surrounding the bore. To implement the process, jets for injecting the sealant into the soil are mounted on the steerable remote-controlled boring head.

24 Claims, 6 Drawing Sheets

METHOD FOR SEALING OFF GROUND SITES

This is a continuation of international application Ser. No. PCT/EP94/01352, filed Apr. 28, 1994.

FIELD OF THE INVENTION

The invention relates to a method for sealing natural or artificially heaped ground sites against an existing or potential gaseous, liquid, radiating and/or solid center of contamination, such as, for example, in the case of abandoned polluted areas (such as abandoned dumping grounds, abandoned locations), waste dumps, pipelines or the like, or also excavated construction sites, using liquid, semiplastic and finely divided sealants or eluates.

BACKGROUND OF THE INVENTION

At the present time, various methods are already known for subsequently encapsulating centers of contamination, particularly disordered garbage dumps, so that the pollutants deposited therein cannot be emitted to the environment.

A method is known from the German Auslegeschrift 3 407 382 for the subsequent underground sealing preferably of dumping grounds. For this method, working pipes are introduced under the waste dump site from a region outside of a waste dump site, without having to drill through the dump site for this purpose. These working pipes are set up below the waste dump from a previously produced vertical shaft produced by a mining method. The sealant is injected from these working pipes with a special apparatus into the soil region. In the case of this method, a very large technical effort is required and the mining procedure for incorporating the working pipes is justifiable only in special cases.

The German Auslegeschrift 34 39 858 discloses that a continuous sealing base is produced with the help of cutting and injection equipment outside of the shielded subterranean curtain surrounding the mass of soil that is to be enclosed by undercutting the latter and is connected tightly with the vertical subterranean curtain. The vertical, supported subterranean curtains, required for this method, once again require a high technical effort and are very expensive.

A further method for the subsequent treatment of waste dumps for protecting the environment is described in the German Auslegeschrift 33 80 897. For this method, the ground surface of the waste dump is divided into immediately adjacent sections. Where the latter are joined, pilot boreholes are made as controlled target boreholes from the starting shafts to the respective opposite draw shafts. Conducting elements are then introduced into these pilot boreholes and their start and end are in opposite starting and draw shafts. In the annular space between the conducting elements, a broaching and injecting apparatus is introduced between the conducting elements and loosens the soil of the sections with a broaching element and prepares it for treatment with a sealant. For this method also, expensive starting and draw shafts are required in order to accommodate the broaching and injection equipment. Moreover, it is not possible to adapt the sealing of the waste dump site to the contours, since the pilot boreholes must run straight for operating the broaching and injection equipment.

From the EP-A-0 317 369, a method for sealing soil sites is known. The known method is an electronic one, for which suitable sealants, such as asphalt or the like, are injected with an electrode, which is subsequently used as injection pipe and, before the sealant is injected, is used to heat the surrounding soil region. The sealant is injected under low pressure through perforation openings introduced in the electrode, so that saturation of the soil takes place.

The technical problem, on which the invention is based, consists of providing a simple method for completely sealing ground sites, particularly centers of contamination such as waste dumps, pipelines or also construction sites, which are still to be excavated, for which method tunnels, flat mining spaces or shafts, produced by mining procedures, are not required.

SUMMARY OF THE INVENTION

This technical problem is solved owing to the fact that a drilling method for producing at least one borehole, the progression of which method is fully controlled, is advanced from the surface outside of the ground site underneath the ground site and that a gaseous, liquid and/or finely divided solid sealant is injected continuously during a longitudinal motion of the drilling head in the borehole into the soil region surrounding the borehole. All forms of introducing the sealant are referred to as injecting in the following.

Due to the drilling method, the progression of which is controlled, all activities can be carried from the surface, so that starting and draw shafts, etc., which are produced by expensive mining procedures, are no longer required.

In this connection, it is particularly advantageous that the boreholes can be adapted, as required, to the contour of the contaminated region for example, as a result of which only a minimum of sealant need be injected into the soil regions. The number and length of the boreholes, required for completely enclosing the center of contamination or the construction site that is still to be excavated, is minimized hereby. Preferably, the drilling diameter for the borehole is up to one meter.

Depending on the soil conditions and on the preliminary investigation of the lower contour of the center of contamination, which investigation either is in existence or still has to be conducted, a safety distance between the boreholes, which have been introduced, and the center of contamination and/or below the lowest points of the investigational boreholes of at least several decimeters is advantageous, in order to achieve absolutely reliable sealing of the center of contamination.

For advancing the boreholes, a known, yet modified, fully controllable, remotely controlled drilling head is used, which enables the boreholes to be advanced in any desired direction and to any desired depth.

The inventive method is particularly simple and efficient, if the sealant is injected continuously into the region of the soil surrounding the borehole during a longitudinal motion of the drill head in the borehole. The injection can take place already while the borehole is being advanced and also when the drilling head or a special broaching device is being retracted towards the inlet opening. The sealant is injected into the soil region through nozzles or outlet openings disposed on the drilling head.

In order to produce a 2-dimensional barrier layer through boreholes, the progression of which is controlled, it is advantageous to bring out the sealant either through at least one lateral nozzle (additional front nozzles are possible) from the rotating drilling strand for producing adjoining to overlapping cylindrical injection sites or, if the drilling strand is not rotating, to bring it out through at least two lateral and/or front nozzles to produce wing-shaped contacting to overlapping injection sites or to have it emerge with a different geometric arrangement of nozzles for the arrangement of injection sites resulting therefrom. The overall objective is to produce barrier layers, which act predominantly horizontally and appear, for example, to be tub-shaped or basin-shaped.

The possibilities for arranging the above-described injection variations are manifold. Advantageously, in the case of non-rotating drilling strands, the injection paths of in each case one borehole, which are produced by at least two injection outlets and lie side by side or above one another, enclose an angle of about 90° to 180°. By these means, percolating water, for example, can run in the thereby formed gutters to the lowest points and be collected and raised in micro-tunnels, which are produced by the same drilling technique and in which filter pipes are installed.

So that the center of contamination is enclosed completely by a barrier layer, it is advantageous to advance a number of boreholes, which are spaced apart and parallel to one another, in the soil. The in each case adjacent regions of a borehole, injected with sealant, should contact one another or intersect a previously produced lamella, that is, a region of soil injected with sealant, so that percolating water can no longer pass through these barrier layers and their overlapping areas into lower layers of soil.

It is also possible to produce such barrier layers next to and underneath the center of contamination, in order to achieve absolutely reliable sealing of the center of contamination. For this purpose, a further number of boreholes is advanced at defined distances from one another at, for example, a vertical angle to the first number of boreholes, which are below the center of contamination, and the sealant once again is injected from these boreholes into the adjacent regions of soil. By these means, two or more, completely closed barrier layers are formed, which surround the center of contamination and ensure absolutely reliably that it is closed off.

In order to achieve reliable sealing of the center of contamination, it is, for example, also possible to advance a network of boreholes, adapted to the contour, underneath the center of contamination, as a result of which the regions of soil, in each case adjacent to a borehole, can be injected several times with sealant. By these means, it is ensured that there are no leaks in the barrier layer formed In the case of multiple barrier layers, the boreholes of beds, adjacent to one another in the vertical direction, are advanced below the center of contamination parallel to and at a distance from one another at an angle of 20° to 160° to a first number of boreholes of the adjacent plane.

It has been observed that the use of a lignite wax emulsion as a liquid sealant has excellent properties. Likewise, polymeric silicates, resins, different waxes or other chemically-resistant injection media, which remain flexible, also have very advantageous properties.

A barrier layer, formed by injecting, for example, a lignite wax emulsion, is very flexible with respect to subsequent settling of the waste dump site and enables flexural deformability of the barrier layer or layers.

Moreover, the barrier layer, formed by the lignite wax emulsion, is resistant to liquid and gaseous materials, which attack the barrier and are present in the percolating, capillary and subterranean water.

It has been observed that a barrier layer, 30 to 60 cm thick, is completely adequate for achieving reliable sealing.

Moreover, in the case of the inventive method, it is possible to admix further materials or, in the case of a multi-layered construction, to introduce also layers with other injective, absorptive and/or sealing materials, in order to achieve outstanding sealing depending on the soil circumstances. Water glass may be used, as may a cement emulsion in admixture with one of the aforementioned sealants.

The high sliding ability of the lignite wax emulsion is particularly useful in the case of the inventive method, since it also enables other substances to be transported well and, for example, causes very little wear at the nozzles and thus makes a long service life of the drilling head possible.

Depending on the permeability structure of the region surrounding the borehole, it is also possible to inject the sealant pursuant to the invention below the frame structure. The barrier layers to be produced can be adapted in an optimum manner to the soil conditions by low pressure injections.

Depending on the nature of the soil or on the permeating materials to be expected, it is advantageous, in the case of several barrier layers, formed pursuant to the invention in a consecutive or superimposed arrangement, if each of the barrier layers is built up of different sealants or injection materials.

An apparatus for carrying out the method advantageously has nozzles at a fully-controllable, remotely controlled drilling head. These nozzles make it possible to introduce the liquid sealant into the soil region with a sensitive or high pressure up to a distance of 2 to 3 m from the borehole wall.

For example, it is particularly advantageous to dispose a first pair of nozzles opposite a second pair of nozzles offset by 5° to 180° with respect to the longitudinal axis of the drilling head. Each of the pairs of nozzles comprises two opposite nozzles, which in each case are directed so that an angle of 30° to 90° is enclosed in each case with the longitudinal axis of the drilling head. By these means, different geometries of soil regions, with concentrations of the material injected, can be produced.

Advantageously, these nozzles can be surrounded by compressed air outlets, which produce a strong air-induced, preparatory cutting or parallel cutting, which makes it possible to form a sealing jet of any shape, the two-dimensional introduction of the sealant into the soil being preferred. Generally, injections by monophasic to multiphasic methods are possible. Due to the barrier layers, which form, for example, two-dimensional gutters and are disposed below the center of contamination, it is possible to direct the percolating water in particular directions. Of course, cylindrically-interlocking barriers can also be produced.

BRIEF DESCRIPTION OF THE DRAWINGS

Several examples for the further explanation and better understanding of the invention are described and explained in greater detail in the following with reference to the drawings, in which.

DETAILED DESCRIPTION OF THE INVENTION

Figure 1:
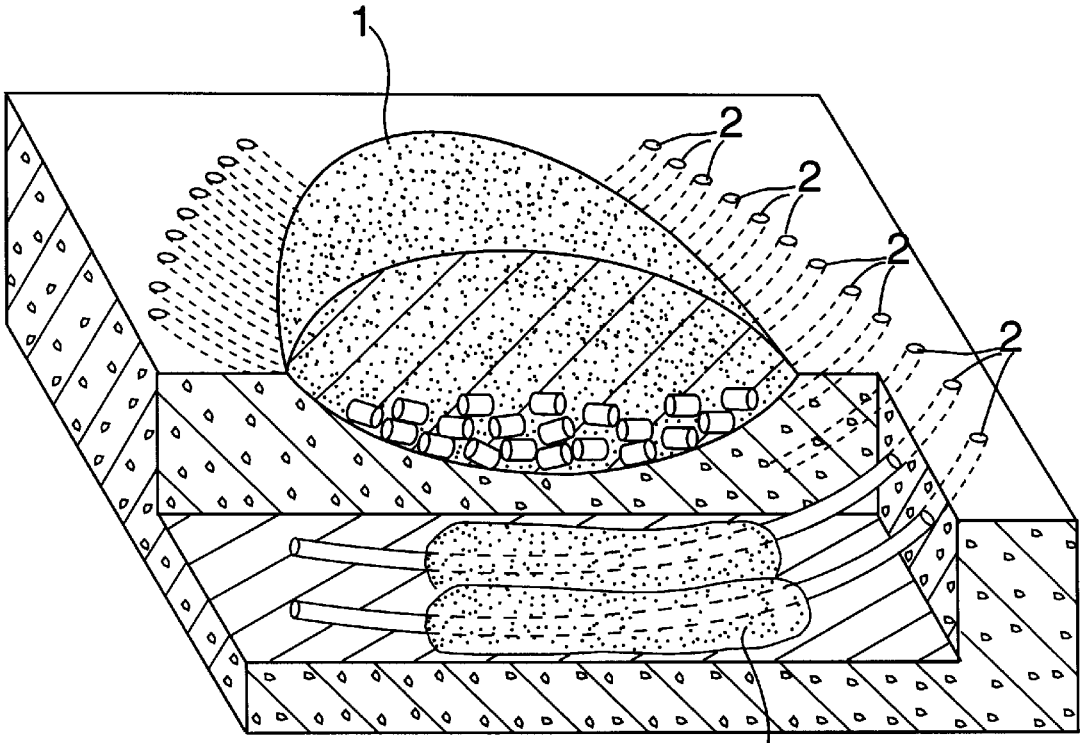
FIG. 1 shows a diagrammatic representation of a contour-adapted sealing of a waste dump by means of the inventive method.
Figure 2:
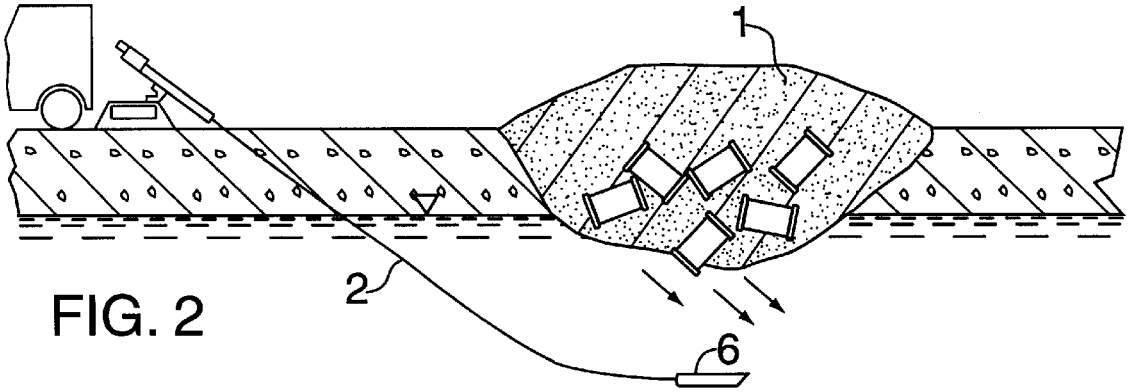
FIG. 2 shows a diagrammatic representation of the drilling bead as it is advancing a borehole under an abandoned dumping ground.
Figure 3:
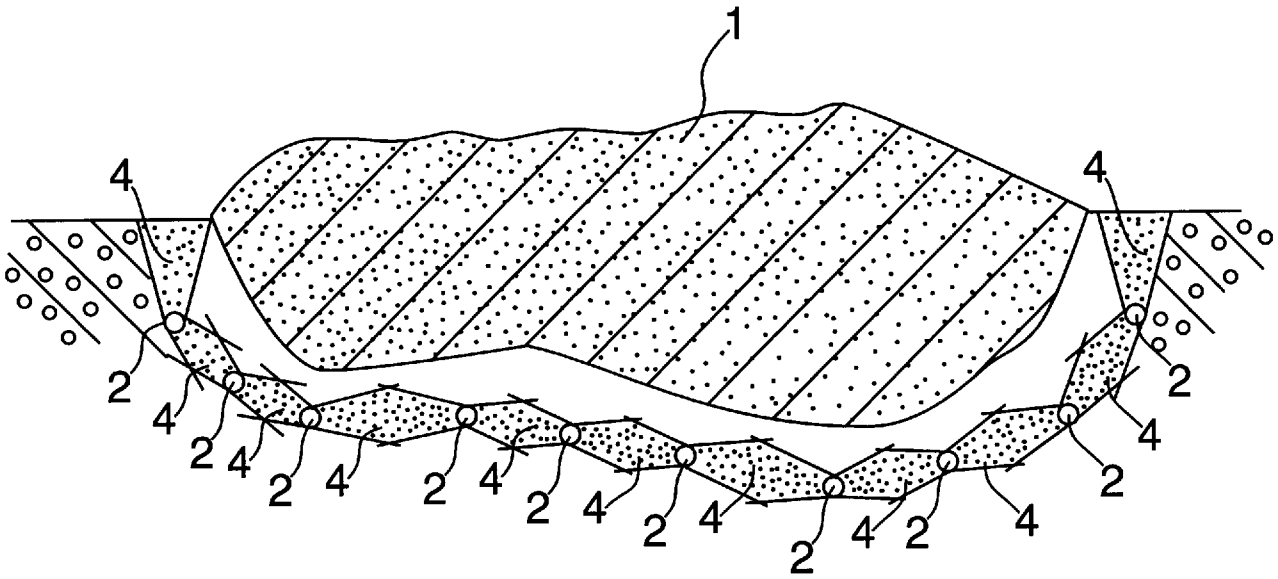
FIG. 3 shows a cross section of a number of boreholes below the waste dump, FIGS. 4 to 10 in each case show a diagrammatic representation of a cross section of a number of boreholes, for which the arrangement of the boreholes to one another as well as the associated injection regions are constructed differently.

As shown in FIGS. 1 to 3, a waste dump site 1 is shaped irregularly in the subterranean part. A number of boreholes 2 are advanced outside of the waste dump site from the surface with known drilling methods, the progression of which is controlled with heed to the contour below the center of contamination and as far as the opposite side of the waste dump site 1.

Starting out from each borehole 2, sealant is injected into the soil regions in each case surrounding a borehole 2, the adjacent regions of a borehole 2 touching or overlapping one another and thus forming a closed barrier layer 3, which runs, with heed to the contour, up to the waste dump site 1.

Figure 2A:
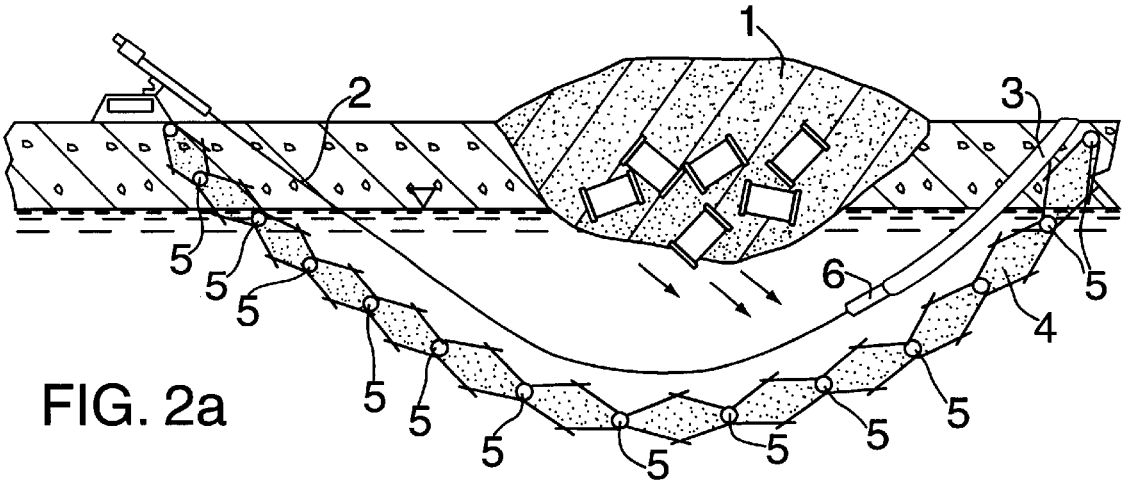
FIG. 2*a* shows a diagrammatic representation of the formation of a barrier layer by injecting a sealant as the drilling head is being retracted.

It can be seen from FIG. 2*a* that a second barrier 4 is formed underneath the first barrier layer 3 by a network of boreholes 5, which are spaced apart and parallel to one another. The network is turned here through an angle of 90°. Starting out from the boreholes 5, injected regions 4 of soil are formed.

The fully-controllable, remotely controlled drilling head 6 is shown in FIG. 2 as it is moving below the waste dump site 1.

Different arrangements of the boreholes are possible for forming a contour-adapted barrier layer. One example is shown in FIG. 3. The boreholes, parallel to one another and spaced apart, are offset slightly to one another in the vertical direction and the two-dimensional barrier layers 4, starting out in each case from a borehole 2, overlap and form an angle of about 120° with one another.

After the course of the contour of the waste dump site 1 has been investigated accurately by means of maps, previously-taken pictures, geophysical photographs, preliminary drilling, etc., a network of boreholes 2, which extend below the waste dump site 1 with heed to the contour, are advanced with the drilling method, the progression of which is fully controlled. At the same time, or while retracting, the liquid sealant, preferably lignite wax, is injected into the soil regions surrounding in each case a borehole. These soil regions 4, mixed with the liquid sealant, in each case overlap and thus form a closed barrier layer 3, which encloses the waste dump site 1 completely and tightly.

In the case of the inventive method, it is not absolutely necessary to take the boreholes 2 as far as a further opening opposite to the inlet opening. Barrier layers 3 can also be introduced only in partial regions of the soil layer.

Figure 4:
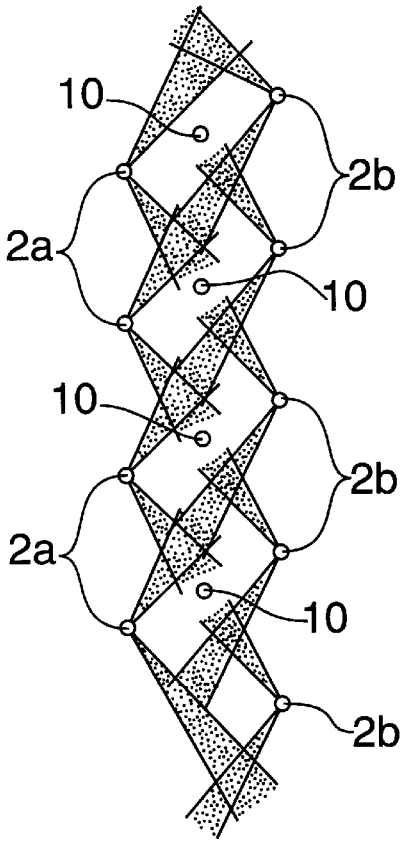

Further examples for the arrangement of boreholes, advanced with the inventive method, are shown diagrammatically in FIGS. 4 to 10. In the case of the examples shown, the boreholes, in each case proceed horizontally or also vertically. They can be introduced from the surface to any place desired, in order to seal the soil site As shown in FIG. 4, a first row of boreholes 2*a* are superimposed on one another in the soil at equal distances from one another. Offset to this first row of boreholes 2*a* is a second row of boreholes 2*b*, which also lie above one another and proceed at the same distances from one another. Extending from each borehole 2*a*, 2*b*, there are two slightly expanded injection regions, the injection region starting out from one borehole enclosing an angle of about 130°. Adjacent injection regions in each case overlap. The injection regions, starting out from the first row of boreholes 2*a* and from the second row of boreholes 2*b*, in each case intersect so that they form completely enclosed regions, in which, for example, further boreholes 10 are introduced, the progression of which is fully controlled and which serve as monitoring boreholes. This arrangement of boreholes 2*a*, 2*b* brings about a sort of double-wall seal.

Figure 5:
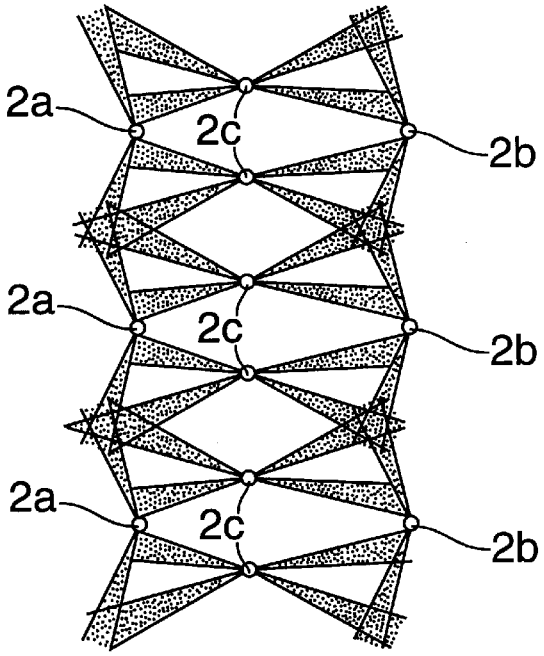

In the case of the arrangement of boreholes 2*a*, 2*b*, 2*c* shown in FIG. 5, there is introduced between the first row of boreholes 2*a* and the second row of boreholes 2*b* a further number of boreholes 2*c* between these boreholes 2*a*, 2*b*. Four individual boreholes of the boreholes 2*c* extend in each case in the cross section of injection regions, which fan out slightly. These regions in turn intersect in each case the two injection regions emanating from the first row of boreholes 2*a* and from the second row of boreholes 2*b*. A very good cross linking of the individual injection regions and, with is that, a very effective sealing of the soil site is ensured hereby.

Figure 6:
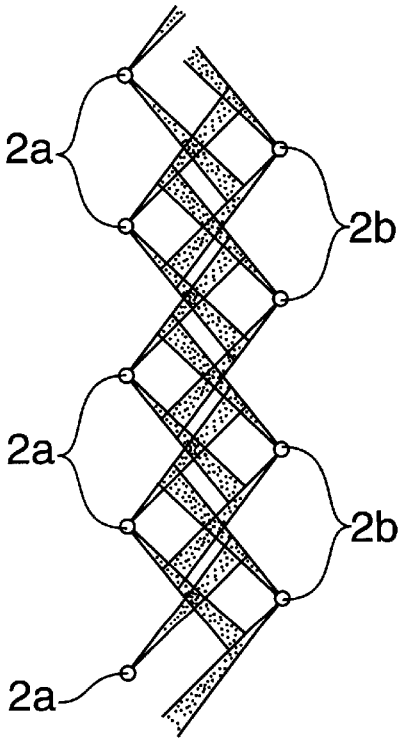

A further diagrammatic representation of the arrangement of boreholes, similar to the arrangement of the boreholes of FIG. 4, is shown, by way of example, in FIG. 6. Compared to the embodiment of FIG. 4, the individual injection regions extend even further into the ground and overlapping injection regions or injection planes, extending along the individual boreholes 2*a*, 2*b*, are formed.

Figure 7:
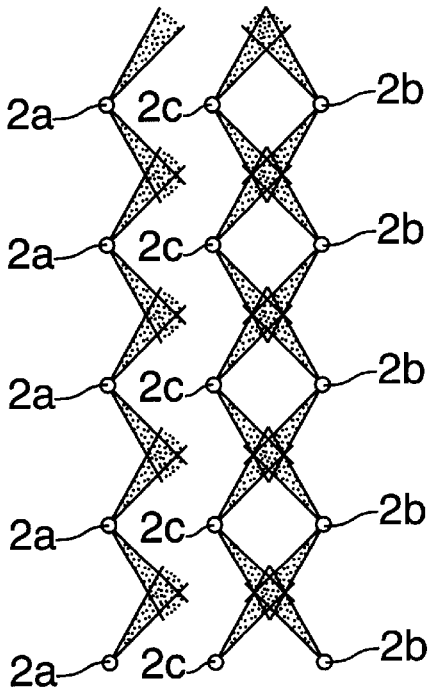

In the case of the example of the arrangement of boreholes 2*a*, 2*b*, 2*c* shown in FIG. 7, a sort of 3-fold wall is formed. For this purpose, a first row of parallel boreholes 2*a* is formed in the ground. Starting out in each case from a borehole, two injection regions enclose an angle of about 130°. Two injection regions of two adjacent boreholes 2*a*, approaching one another, cross one another and thus form a first sealing wall. A row of boreholes 2*c* of similar construction is parallel to and offset from the first row of boreholes 2*a*. A third row of boreholes 2*b* with associated injection regions is disposed in mirror image fashion parallel to the second row, as a result of which the injection regions, extending from the individual boreholes 2*b*, 2*c*, cross over one another and, in cross section, form a chess board-like arrangement of injection planes. Once again, a reliable sealing of the soil site is ensured.

The construction of the injection regions, shown in FIGS. 4 to 7, arise owing to the fact that, as it is being retracted, the drilling head carries out a rotation and injection material is injected uniformly into the surrounding soil region through different arrangements of nozzles. The diagrammatically shown injection regions are thus, in actual fact, barrier layers or planes, in which the injected material is accumulated and which extend from the boreholes. It is self-evident that the boreholes can be horizontal, vertical or inclined at any angle, since these are introduced starting from the surface and are advanced in a manner, in which their progression is controlled completely, below the soil site that is to be sealed.

In the case of the further examples 8 to 10, further, diagrammatically shown arrangements of boreholes are shown by way of example, for which, however, the drilling head swings back and forth within a specified angular range or rotates constantly about its longitudinal axis.

Figure 8:
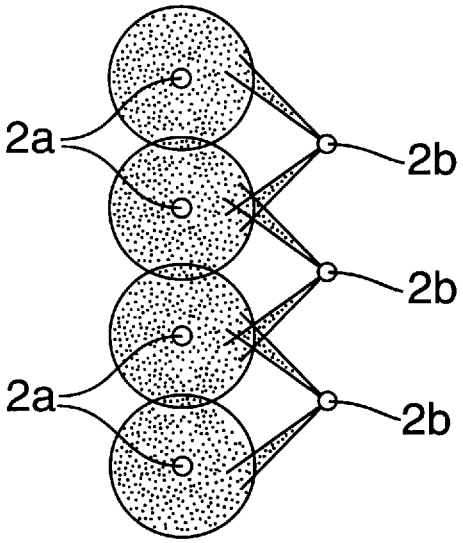

FIG. 8 shows a cross section of a number of boreholes 2*a*, 2*b*, for which, as the drilling head is retracted or also already as the individual boreholes 2*a* are being advanced, injection material is injected constantly, with rotation of the drilling head, into the surrounding soil region. By these means, columnar injection regions are formed about, in each case, one borehole 2*a*. The boreholes 2*a* are at such a distance from one another, that the injection regions of an adjacent borehole in each case overlap. Parallel to this, there are further boreholes 2*b*, from which individual soil layers extend, in which the injected material is concentrated and which, in turn, intersect the columnar injection regions about the borehole 2*a*.

Figure 9:
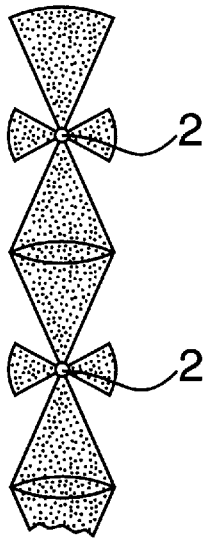
Figure 10:
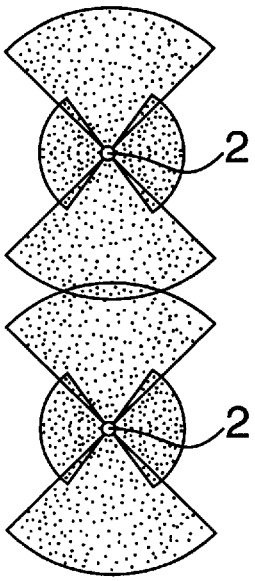

For the cross sections of the boreholes, shown diagrammatically in FIGS. 9 and 10, the drilling head 6, as it is being retracted, can swing back and forth through a specified angle. Pairs of nozzles, which cause the injected material to penetrate the region around the borehole to a different depth, are mounted on either side of the drilling head. By these means, two pairs of injected regions are formed in each case in the region of a borehole 2, one pair having a larger radius and the pair, disposed at right angles thereto, having a smaller radius. The boreholes 2 once again are parallel to one another and are at such a distance from one another, that the injected regions of larger radius intersect one another. By these means, once again, effective sealing is achieved, for which the region of soil next to the borehole is also injected absolutely tightly with injection material. For the example shown in FIG. 9, the swiveling angle is about 45° and, for the example shown in FIG. 10, the drilling head is swung back and forth through an angle of about 90° to 100°.

Figure 11:
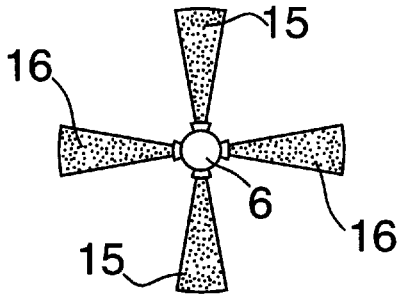
FIG. 11 shows a diagrammatic representation of a front view of a drilling head with nozzles aligned in different directions.
Figure 12:
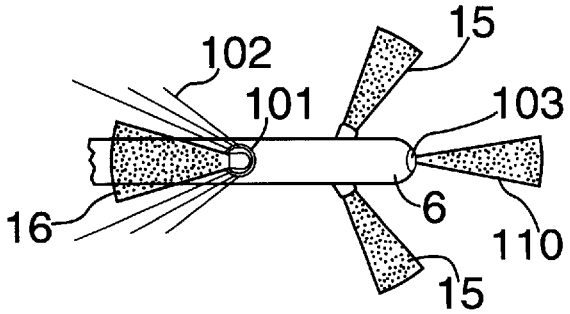
FIG. 12 shows a diagrammatic representation of the side view of the drilling head shown in FIG. 11.

FIGS. 11 and 12 show a diagrammatic representation of the arrangements of the nozzles at the drilling head 6, which is used advantageously for the Examples given FIG. 11 is a front view and shows the nozzles, which are arranged in pairs on opposite sides and have injection angles 15 and 16. FIG. 12 is a side view of the drilling head 6 of FIG. 11, for which the front pair of nozzles is directed slightly forwards and the rear pair of nozzles, turned through 90° with respect to the front pair, is directed slightly towards the rear. FIG. 12 also shows compressed air outlet 101 surrounding one of the outlet nozzles, which optionally can be used to shape jet 102, and further shows an optional front nozzle 103 for producing a jet 110 oriented in the longitudinal direction of the borehole.

Figure 13:
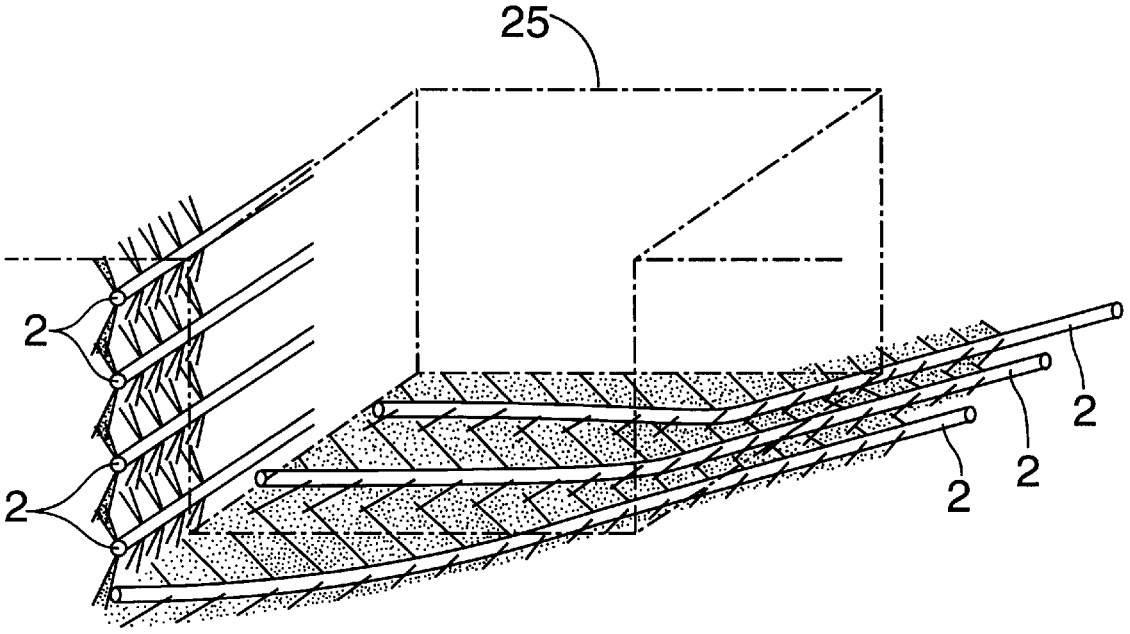
FIG. 13 shows a diagrammatic representation of the progression of the boreholes and of the injection regions for sealing an excavation.

FIG. 13 shows a further area of use of the inventive method, for which an excavation is sealed as protection against intrusion of water or infiltration of pollutants. The boreholes 2 are introduced here from a location outside of the intended excavation 25 up to the desired depth. Depending on circumstances, a sealing tub is created by one of the arrangement of boreholes, described, by way of example, above and by injecting the injection material. Since different boreholes 2 can be advanced from the one location with the inventive drilling method, only one change in location of the drilling equipment is required for sealing a diagrammatically shown excavation 25. Starting out from a first location, boreholes 2 are advanced underneath the intended excavation 25 and injection material is injected in each case, so that a sealing tub results. Starting out from a further location, horizontal boreholes 2 are advanced with intersecting injection regions in such a manner with respect to the already produced boreholes, that the soil tub, formed first, is intersected and the soil site or the intended excavation 25 is enveloped tightly. The pit 25 can now be excavated and ground water or pollutant-containing percolated water cannot penetrate into it.

FIGS. 14 to 18 show a further area of use of the inventive drilling method.

Figure 14:
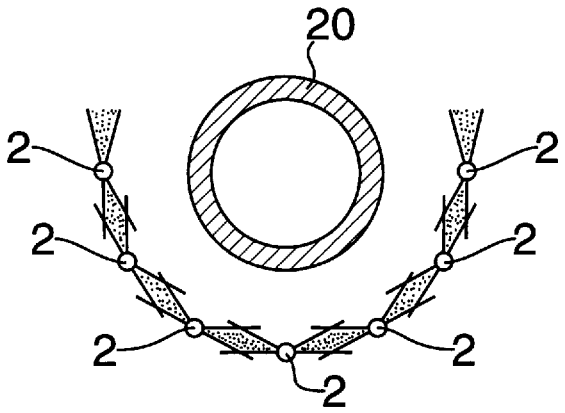
FIG. 14 shows a diagrammatic representation of a cross section of a pipeline with boreholes and injection regions introduced parallel thereto.

FIG. 14 shows a cross section through a pipeline 20 in the soil, which serves, for example, for carrying away pollutant-containing, percolated water. Since these pipelines 20 in many cases are porous and old, subsequent sealing of the soil layers beneath them frequently is necessary. As shown in FIG. 14, a number of boreholes 2, parallel to the pipeline 20, are advanced from the surface for this purpose. While the drilling head is being retracted, injection material is injected uniformly in two-dimensional jets into the surrounding regions of soil. At the same time, the individual boreholes 2 are parallel to one another on a shell surface about the center of the pipeline 20. The injection regions of adjacent boreholes 2 intersect once again. Accordingly, a collection channel is formed beneath the pipeline 20 and collects and carries away the pollutants trickling out in the event of a leak.

Figure 15:
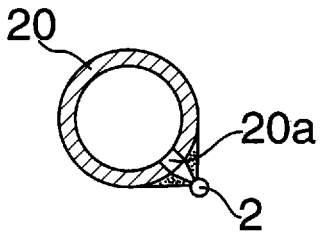
FIG. 15 shows a diagrammatic representation of a cross section of a pipeline with a leak, which is sealed by a borehole.

FIG. 15 shows a defect 20*a* in a pipeline 20, through which pollutants trickle into the layers of soil below. This defect can be repaired with the inventive method. For this purpose, a borehole 2 is taken, starting out from the surface, to the located defect 20*a* and injection materials are injected from the borehole 2 into the soil region in such a manner that these materials extend up to the pipeline 20 and tightly enclose the defect 20*a*.

Figure 16:
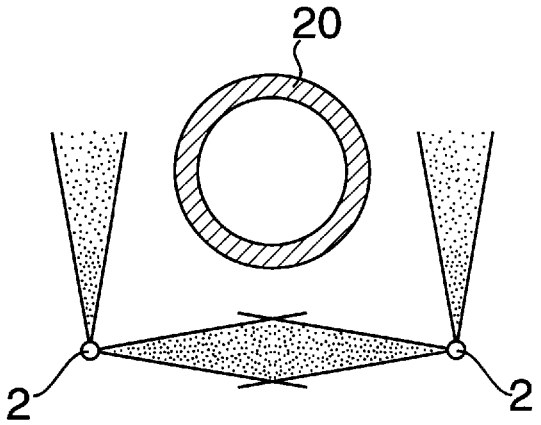
FIG. 16 shows a further diagrammatic representation for completely sealing a pipeline.

FIG. 16 shows a cross section of a pipeline 20, which is surrounded in a lower partial region by two parallel boreholes 2 with injection regions emanating perpendicularly from each borehole 2.

Figure 17:
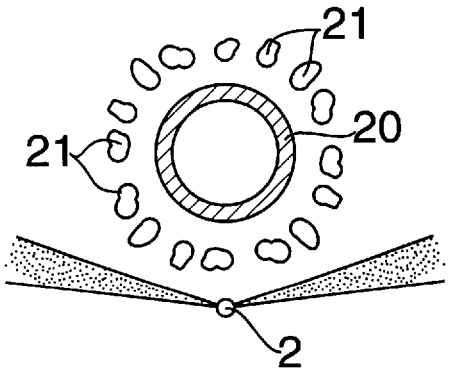
FIG. 17 shows a diagrammatic representation of a cross section of a pipeline, which is surrounded with contaminated fragments of a destroyed pipe and is secured by a borehole advanced below and by injections.
Figure 18:
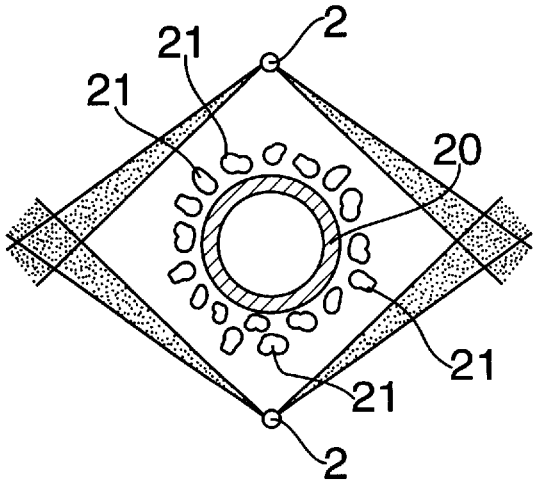
FIG. 18 shows a further diagrammatic representation of a cross section of FIG. 17, which is enveloped completely according to the inventive method by boreholes and injections.

FIGS. 17 and 18 show yet another area of use of the inventive method In many cases, the dimensions of the pipeline 20 for carrying away percolated water are too small and there is therefore a need for pipelines of larger cross section. In a well-known method, the older pipelines are destroyed for this purpose in a "pipe-bursting" or "pipe-eating" method and replaced by larger pipelines. In the case of this known method, however, the problem continues to exist that the fragments 21 of the older pipelines furthermore contain pollutants, which can reach the layers of soil below. To secure these layers below, a borehole 2 is advanced from the surface and injection material is injected into the surrounding regions of soil, so that either, as shown in FIG. 17, a half-shell is formed, which forms a channel for carrying away this percolated water, or, as shown in FIG. 18, several boreholes 2 are advanced, the injection regions of which completely envelope and tightly encapsulate the new pipeline 20 and the fragments 21 of the older pipeline.

We claim:

1. A method for sealing a contaminated soil site, comprising the steps of investigating the course of the contour of the contamination within said site;

advancing a plurality of boreholes underneath said site using a fully controllable, remotely controlled drilling head;

while advancing said drilling head or while retracting said drilling head within one of said plurality of boreholes, injecting a sealant at high pressure in the region of soil surrounding said one borehole to form an injection site, said high pressure being characterized as being sufficient to introduce said sealant into the region of soil up to distances of two to three meters from said said one borehole;

wherein said plurality of boreholes are substantially parallel to one another and spaced from one another so that the injection sites of adjacent boreholes overlap; and wherein the step of advancing said fully controllable, remotely controlled drilling head comprises forming a layer of sealant that is adapted to said contour of contamination within said site.

2. The method of claim 1, wherein the step of advancing said plurality of boreholes further comprises advancing said boreholes at a safe distance from said contour of contamination with said site, underneath which they are to pass.

3. The method of claim 2, wherein, in so advancing at said safe distance, said distance is maintained at least a few decimeters.

4. The method of claim 1, wherein the step of injecting said sealant further comprises injecting said sealant into said region through nozzles disposed on said drilling head.

5. The method of claim 4, wherein the step of injecting said sealant through said nozzles further comprises injecting said sealant into said soil region in at least one two-dimensional jet.

6. The method of claim 4, wherein the step of injecting said sealant through said nozzles further comprises injecting said sealant into said soil region in two or more two-dimensional jets.

7. The method of claim 6, wherein the step of injecting said sealant into said soil region in said two or more two-dimensional jets further comprises injecting said sealant, during said longitudinal motion of said drilling head, in two or more planes, the outermost of which planes enclose an angle of approximately 90° to 180°.

8. The method of claim 8, wherein the injection step further comprises injecting said sealant by monophasic to multiphasic methods at least one of said nozzles on said drilling head, wherein said at least one nozzle is surrounded by an air outlet that directs said sealant jet in a desired form or aids the penetration of said sealant.

9. The method of claim 8, wherein the injection step further comprises injecting said sealant into said soil region through first and second pairs of nozzles disposed on said drilling head, which nozzles pairs, with respect to the longitudinal axis of said drilling head, are offset by approximately 5° to 180° relative to each other, and wherein each of said pairs of nozzles comprises two opposite nozzles, each of said opposite nozzles enclosing an angle of approximately 30° to 90° with the longitudinal axis of said drilling head.

10. The method of claim 1, wherein the step of injecting said sealant further comprises injecting said sealant into said soil region in the longitudinal direction of said one borehole.

11. The method of claim 1, wherein said step of advancing said plurality of boreholes further comprises commencing said step of advancing from a common starting area, diverging in a fan-shaped fashion, and then turning so as to align said boreholes in said parallel pattern.

12. The method of claim 1, wherein said injecting step further comprises injecting the sealant from one or more of said plurality of boreholes into at least two intersecting soil regions adjacent to said one or more borehole from which said sealant was injected.

13. The method of claim 1, wherein said injecting step further comprises injecting the sealant such that adjacent regions of soil, injected with said sealant, are disposed with respect to one another in such a manner that said layer of sealant comprises gutters that are spaced apart.

14. The method of claim 1, wherein said injecting step further comprises injecting the sealant continuously into said soil region only in a partial region along one or more of said boreholes.

15. The method of claim 1, wherein said drilling step further comprises commencing the drilling of one or more of said boreholes from a first area on the surface of said soil site outside of the contaminated area thereof, then drilling under said contaminated area, and then emerging at a second area on said surface outside of said contaminated area.

16. The method of claim 1, wherein said injection step further comprises injecting a sealant selected from the group consisting of a lignite wax emulsion, a polymeric silicate, water glass, resin and different waxes.

17. The method of claim 16, wherein the step of injecting said sealant further comprises injecting a sealant that is a cement emulsion in admixture with one of said sealants of claim 16.

18. The method of claim 1, wherein said step of injecting further comprises completely enclosing the contaminated soil site within said layer of sealant, formed from said injected sealant in said overlapping injection sites.

19. A method for controlling a sealing formed by the method of claim 1, said sealing forming barrier layers, wherein the step of advancing said plurality of boreholes comprises fully controlling the progression of said plurality of boreholes into or below said barrier layers, introducing control elements into said plurality of one borehole and transmitting values, reported by said control elements, to above-ground evaluating equipment.

20. The method of claim 1, wherein the step of drilling said plurality of boreholes further comprises drilling said plurality of boreholes each with a diameter of up to one meter.

21. The method of claim 1 practiced in repetition, whereby a plurality of barrier layers of sealants are formed in a superimposed arrangement underneath said contaminated soil site.

22. The method of claim 21, further comprises the step of constructing each of said barrier layers from a different sealant.

23. The method claim 21, further comprising turning said each superimposed layer is turned through an angle of approximately 20° to 180° and ideally of 90° with respect to the alignment of the layer above it.

24. The method of claim 1 practiced in repetition, a consecutive arrangement of layers of sealant underneath said contaminated soil site.

* * * * *